United States Patent [19]

Nishio

[11] Patent Number: 4,571,835

[45] Date of Patent: Feb. 25, 1986

[54] METHOD OF DEPICTING A SOLID

[75] Inventor: Motomitsu Nishio, Tama, Japan

[73] Assignee: Canon Kabushiki Kaisha, Tokyo, Japan

[21] Appl. No.: 731,342

[22] Filed: May 6, 1985

Related U.S. Application Data

[63] Continuation of Ser. No. 451,237, Dec. 20, 1982, abandoned.

[30] Foreign Application Priority Data

| | | | |
|---|---|---|---|
| Dec. 25, 1981 | [JP] | Japan | 56-209095 |
| Dec. 26, 1981 | [JP] | Japan | 56-210617 |
| Dec. 28, 1981 | [JP] | Japan | 56-215782 |
| Dec. 28, 1981 | [JP] | Japan | 56-215783 |
| Dec. 28, 1981 | [JP] | Japan | 56-215784 |

[51] Int. Cl.[4] ..... B43L 13/16

[52] U.S. Cl. ..... 33/20.1; 33/21.1

[58] Field of Search ..... 33/1 M, 18 R, 18 C, 33/20 R, 20 B, 20 C, 20 D, DIG. 21, 21 R; 350/174; 434/85, 92

[56] References Cited

U.S. PATENT DOCUMENTS

| | | | |
|---|---|---|---|
| 2,387,021 | 10/1945 | Hendershot | 350/174 |
| 2,704,960 | 3/1955 | Loud, Jr. | 33/20 D |
| 3,116,555 | 1/1964 | Helava | 33/20 D |
| 3,445,855 | 5/1969 | Grant | 33/DIG. 21 |
| 3,989,933 | 11/1976 | Inghilleri | 33/20 D |
| 4,399,612 | 8/1983 | Scott | 33/20 R |

FOREIGN PATENT DOCUMENTS

| | | | |
|---|---|---|---|
| 2365081 | 4/1978 | France | 33/18 R |

*Primary Examiner*—Richard R. Stearns

*Attorney, Agent, or Firm*—Fitzpatrick, Cella, Harper & Scinto

[57] ABSTRACT

Disclosed is a solid depicting method which comprises obliquely disposing a semi-transparent mirror between a solid to be depicted and the position of observation by two eyes, disposing recording paper across the virtual image of the solid formed by means of the semi-transparent mirror, moving the virtual image relative to the recording paper in a direction perpendicular to the recording paper, and tracing the locus of the point of intersection between the surface of the virtual image of the solid and the recording paper.

3 Claims, 8 Drawing Figures

METHOD OF DEPICTING A SOLID

This application is a continuation of application Ser. No. 451,237 filed Dec. 20, 1982, and now abandoned.

BACKGROUND OF THE INVENTION

1. Field of the Invention

This invention relates to a method of depicting solids of any shape and any size easily and accurately by the orthographic projection method.

2. Description of the Prior Art

With conventional depicting devices designed to sketch the shapes of solids and the surface patterns thereof by utilization of a semi-transparent mirror, depiction is effected by the center projection method by which the portion of a solid nearer the observer is depicted in larger dimensions as in photography. Therefore, the depicted shapes are distorted relative to the actual shapes of the solids, and this had led to the necessity of actually measuring the dimensions of each portion in the case of depiction of cultural objects or the like. Accordingly, such depicting devices are not so practicable for scientific use. With the orthographic projection method, as compared therewith, the scale is constant over all the surface of paper and therefore the shapes of solids and the surface patterns thereof can be expressed without distortion, and therefore a solid depicting device which can depict by such orthographic projection method has been desired.

Now, in the depicting device according to the prior art, it is the basic principle to observe a solid by one eye. This is because it is necessary to make planar the virtual image of the solid by observing the solid by one eye and to thereby make it easy to depict the solid, and because it has been considered that, with two eyes, a virtual image involving a cubic effect (three-dimensional effect) is observed to make depiction impossible.

When the virtual image of a solid is observed by two eyes with the aid of a depicting device utilizing a semi-transparent mirror, the virtual image of the solid rises and falls relative to the depicting table at a point whereat the optical path length from the observation position to the depicting table becomes substantially equal to the optical path length from the observation position to the actual solid, and so the depicting table and the virtual image of the solid can be observed as "intersecting bodies", so called in the art of drawing, by appropriately adjusting the contrast of the two. In the case, at the point of intersection between the surface of the depicting table and the surface of the virtual image of the solid, they are located at the same optical path length from the observation position. Therefore, by depicting, on the depicting table, only the point or portion of intersection between the surface of the virtual image of the solid and the surface of the depicting table while relatively decreasing or increasing the distance from the solid to the observation position, the dimensional scales of the virtual image of the solid depicted on the depicting table all become equal and it is apparent that the thus depicted image is an orthographically projected image.

SUMMARY OF THE INVENTION

It is a first object of the present invention to provide a solid depicting method capable of depicting solids by the orthographic projection method on the basis of the above-described finding. In order to achieve this, according to an embodiment of the present invention, a semi-transparent mirror inclined with respect to the observation direction toward a depicting table on which table a solid is sketched is provided between the depicting table and the position of observation by two eyes, so that the virtual image of the solid can be formed on the depicting table through the semi-transparent mirror. The solid is relatively moved in the direction of the depth of the virtual image of the solid while only the portion of intersection between the surface of the virtual image of the solid and the surface of the depicting table is depicted.

With the depicting device according to the prior art, even when the solid lies at a great distance such as infinity, the virtual image of the solid is observed as a planar image having no perspective (the effect of distance) and therefore, the solid can be depicted without any hindrance; whereas with the method of the present invention, a virtual image having perspective (the effect of distance) is observed and therefore, an orthographically projected image cannot be depicted unless the distance (optical path length) from the observation position to the solid is made equal to the distance (optical path length) from the observation position to the depicting table. That is, in the method of the present invention, depiction of a solid lying at a distance greater than the reach of the draftsman or of a large solid becomes impossible.

It is a second object of the present invention to enable an orthographically projected image of such a large solid or a solid lying at a great distance to be depicted. In order to achieve this, according to another embodiment of the present invention, a semi-transparent mirror inclined with respect to the observation direction toward a screen is provided between the screen and the position of observation by two eyes, and a light ray generator for applying a light ray toward the screen is provided for movement in a direction parallel to the screen. The virtual image of the solid is observed on the screen through the semi-transparent mirror, and the solid is relatively moved in the direction of the depth of the virtual image of the solid while the portion of intersection between the screen and the surface of the virtual image of the solid is traced by the light ray from the light ray generator, and the virtual image of the solid is depicted by a plotter adapted to follow the movement of the light ray generator.

According to still another embodiment of the present invention, a semi-transparent mirror inclined with respect to the observation direction toward a screen comprising a number of arranged photoelectric conversion elements is provided between the screen and the position of observation by two eyes, and a light ray generator for applying a light ray capable of pointing to all of the photoelectric conversion elements of the screen is provided. The virtual image of the solid is observed on the screen through the semi-transparent mirror, and the solid is relatively moved in the direction of the depth of the virtual image of the solid while the portion of intersection between the screen and the surface of the virtual image of the solid is traced by the light ray from the light ray generator, and the coordinates of this portion on the screen are detected and the virtual image of the solid is depicted by the thus detected coordinates with the aid of a plotter.

The invention will become more fully apparent from the following detailed description thereof taken in conjunction with the accompanying drawings.

DESCRIPTION OF THE PREFERRD EMBODIMENTS

Figure 1:
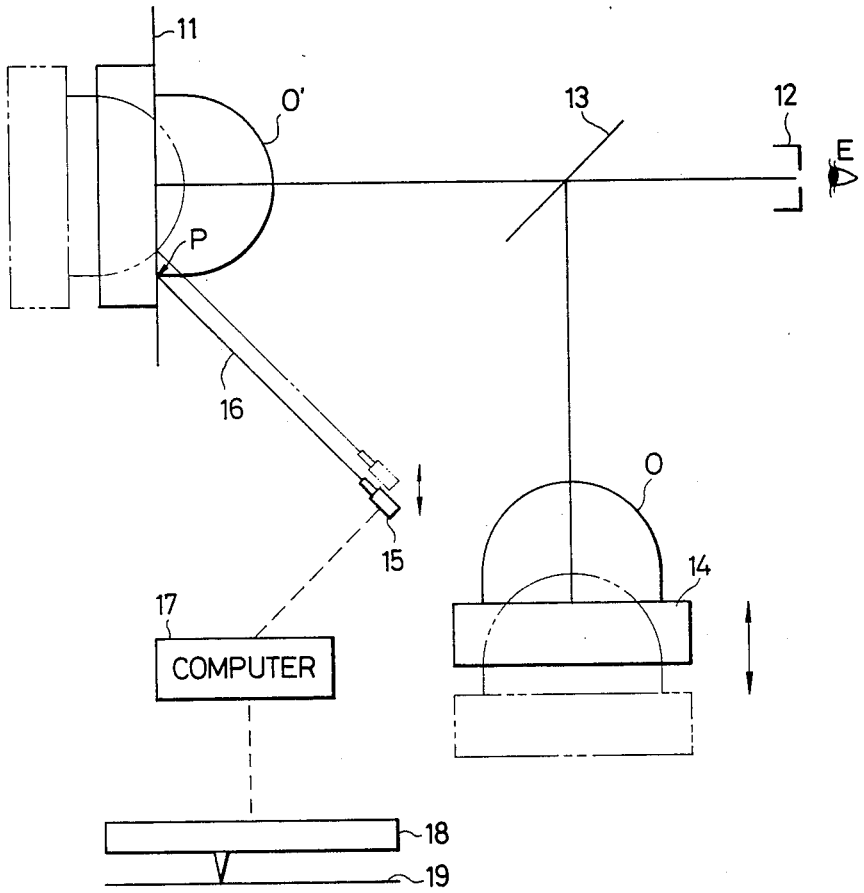
FIG. 1 illustrates the method according to a first embodiment of the present invention.

An embodiment of the solid depicting method according to the present invention using the orthographic projection method will hereinafter be described in more detail by reference to FIG. 1, which illustrates the principle thereof. Between a display medium such as a screen 11 and an eyepiece portion 12 for two eyes E, there is disposed a semi-transparent mirror 13 inclined with respect to the direction of observation by the eyes E, and a solid O on a supporting bed 14 is observed by the eyes E by means of the semi-transparent mirror 13. The supporting bed 14 is movable toward and away from the eyepiece portion 12, and the virtual image O' of the solid is observed as if it rose and fell relative to the screen 11 due to movement of the supporting bed 14. A laser oscillator (light ray generator) 15 movable in a direction parallel to the screen 11 by the draftman's operation is provided to apply a thin convergent beam 16 to the portion of intersection P between the surface of the screen 11 and the surface of the virtual image O', and the then position of the laser oscillator 15 is plotted on the surface of depicting paper 19 by an X-Y plotter 18 through a computer 17 such as a microprocessor.

Accordingly, by continuously tracing the portion of intersection P between the surface of the virtual image O' of the solid O and the surface of the screen 11 by means of the convergent beam 16 from the laser oscillator 15 while moving the supporting bed 14, the outline of the virtual image O' of the solid O and the pattern of the surface thereof are automatically depicted on the depicting paper 19 by the X-Y plotter 18. In this case, the optical path length from the eyepiece portion 12 to the portion of intersection P is always constant and therefore, the depicting scale on the depicting paper is constant on all the surface thereof and the depicted image is an orthographically projected image. Where the distance between the screen 11 and the eyepiece portion 12 is short, the depicting paper 19 may be attached to the screen 11 and the draftsman may sketch directly, but again in such case, it is necessary to sketch only the portion of intersection P. Also, it will be effective to apply a faint illuminating light from the back of the screen 11 in order to make the portion of intersection P clearer by equalizing the contract ratio of illumination between the screen 11 and the solid O.

In the present embodiment, the virtual image O' of the solid O is horizontally reversed image and therefore, if the left- and right-position coordinates of the laser oscillator are inversely pre-corrected by the computer 17 or the like or when a bilaterally symmetric solid is to be depicted, no problem will occur.

Figure 2:
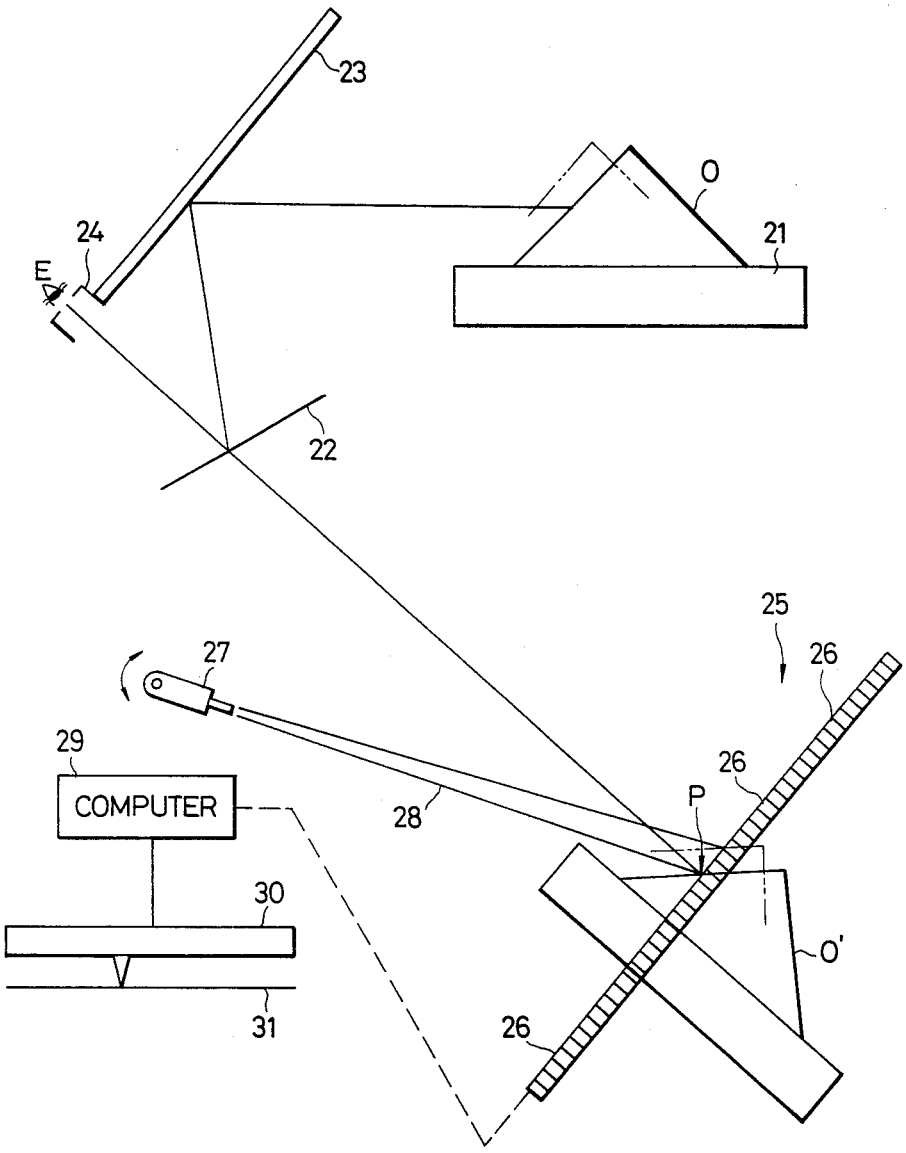
FIG. 2 illustrates the method according to a second embodiment of the present invention.

Now, description will be made of FIG. 2, which illustrates the principle of another embodiment of the present invention.

Between an obliquely downwardly set eyepiece portion 24 for two eyes E and an obliquely upwardly positioned depicting screen 25 opposed to the eyepiece portion 24, there is positioned a semi-transparent mirror 22 obliquely upwardly inclined with respect to the observation direction. The depicting screen 25 comprises a number of regularly arranged photoelectric conversion elements 26.

A supporting bed 21 disposed forwardly of the eyepiece portion 24 has, in the back and forth direction (the depth direction of a solid O), a movement stroke greater than the depth of the solid O supported thereon. Just above the eyepiece portion 24 which is above the semi-transparent mirror 22, a totally reflecting mirror 23 for observing the image of the solid O through the semi-transparent mirror 22 is fixed in inclined position.

Accordingly, by setting the optical path length from the semi-transparent mirror 22 to the solid O and the optical path length from the semi-transparent mirror 22 to the depicting screen 25 to be substantially equal, the virtual image O' of the solid O can be observed on the depicting screen 25. At this time, by attaching a sheet of depicting paper to the depicting screen 25 and depicting only the portion of intersection P between the surface of the depicting paper and the surface of the virtual image O' while moving the depicting screen 25, the outline of the virtual image O' of the solid O and the pattern of the surface thereof can be depicted in orthographic projection. (For convenience, the term "display medium" is used herein, throughout, to include both a depicting or other screen, and a sheet of paper of other recording medium.) Where the solid O is small or lies at a short distance as the draftsman's reach, depiction can be effected directly on the depicting screen 25, but where the solid O is large or lies at a distance of several meters or more, depiction has to be effected without using the supporting bed 21. In such case, the distance to the depicting screen 25 also is long and therefore, it is preferable to adopt the construction described hereinafter.

A laser oscillator (light ray generator) 27 is swingably provided for enabling the draftsman himself to cause a light ray 28 to point to the portion of intersection P between the surface of the depicting screen 25 and the surface of the virtual image O'. Signals from the photoelectric conversion elements 26 irradiated with this light ray are input to a computer 29 such as a microprocessor so that the portion of intersection P is plotted on depicting paper 31 by an X-Y plotter 30 operationally controlled by the signal from the computer 29. Thereby, depiction by automatic remote control becomes possible.

While, in the present embodiment, the computer 29 receives the signal from the depicting screen 25, the depicting screen 25 may be formed into a mere plate-like form and the laser oscillator 27 may be moved in a direction parallel to the depicting screen 25, in order to cause the light ray 28 to point to the portion of intersection P, and the movement signal of the laser oscillator 27 may be input to the computer 29 to cause the X-Y plotter 30 to operate. It is also possible to use, instead of the laser oscillator 27, an optical instrument which can converge the light rays onto the surface of the depicting screen 25. When it is difficult to move the solid O, the entire apparatus may be moved as a unit with respect to the direction of the depth of the solid.

Thus, according to the present embodiment, the depicting screen is obliquely disposed in front of the draftsman and therefore, when direct depiction is to be effected, fatigue can be remarkably reduced even during a long period of depicting work, and the work efficiency can be improved. Also, in the present embodiment, the supporting bed can be observed laterally and therefore, the elevation view of a solid can be depicted. This is very convenient to depict cultural objects such as earthenware and pots. Further, where a large solid or a solid lying at a great distance is to be depicted, the light ray from the light ray generator is applied to the depicting screen beyond the reach of the operator and the plotter automatically follows the movement of this light ray. Therefore, for example, the orthographic projection image of an automotive vehicle or a colossal statue which could not be depicted by the prior art apparatus can be depicted easil y and accurately.

Figure 3:
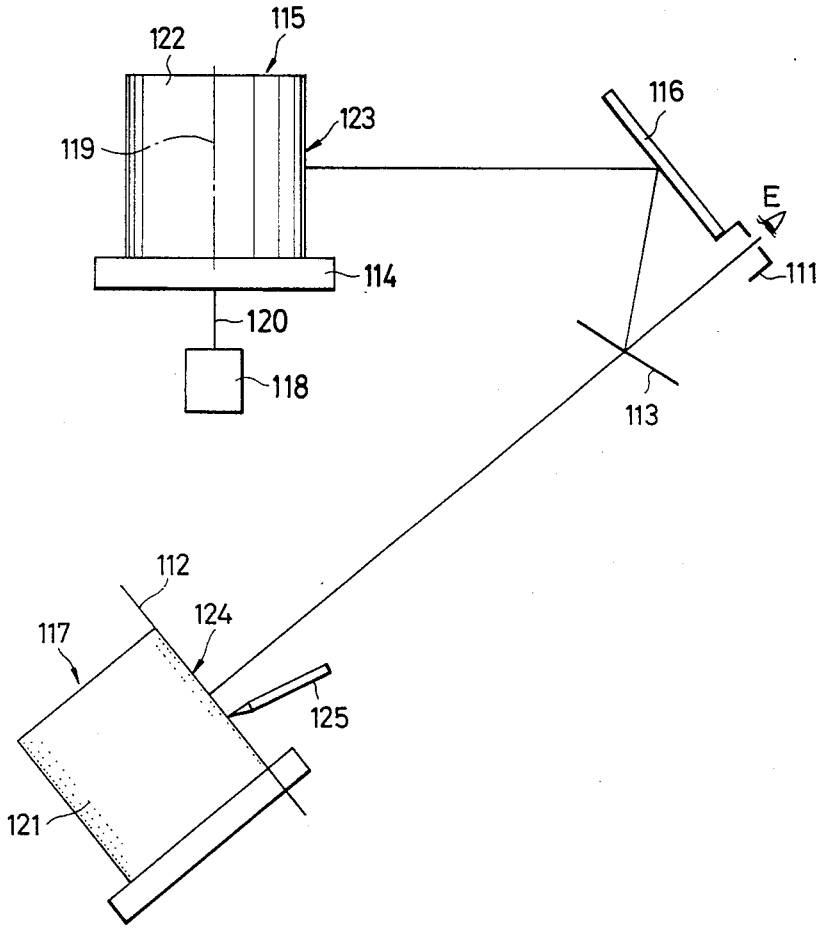
FIG. 3 illustrates the method of the present invention in the case the solid is a column.

Next, a version of the method of depicting the surface pattern of a column or a cylinder in accordance with the present invention will now be described in detail by reference to FIG. 3, which illustrates the operation principle thereof. A depicting screen 112 on which depicting paper, not shown, may be placed is provided forwardly of an eyepiece portion 111 for two eyes E, and a semitransparent mirror 113 inclined with respect to the observation direction is disposed between the depicting screen 112 and the eyepiece portion 111. A totally reflecting mirror 116 for observing a column 115 on a supporting bed 114 through the eyepiece portion 111 is provided above the semi-transparent mirror 113. The optical path from the eyepiece portion 111 to the column 115 is bent twice, by the semi-transparent mirror 113 and the totally reflecting mirror 116, and therefore, the operator can observe the virtual image 117 of the column 115 as an erect positive image. The supporting bed 114 can be rotated by a drive motor 118, and the column 115 is positioned on the supporting bed 114 so that the axis 119 of the column 115 is coaxial with the rotary shaft 120 of the supporting bed 114. The depicting screen 112 is reciprocally movable in a direction perpendicular to the plane of the drawing sheet of FIG. 3 at a speed coincident with the peripheral speed of the outer peripheral surface 122 of the column 115 in synchronism with the drive motor 118. Further, care is taken so that no deviation occurs between the phase of the outer peripheral surface 121 of the virtual image 117 and the phase of the depicting paper on the depicting screen 112. The optical path length from the front end 123 of the outer peripheral surface 122 of the column 115 to the eyepiece portion 111 is set equally to the optical path length from the depicting paper, i.e., the surface of the depicting screen 112, to the eyepiece portion 111, whereby the front end 124 of the outer peripheral surface 121 of the virtual image 117 is coincident with the surface of the depicting screen 112.

When only the portion of the front end 124 of the outer peripheral surface 121 of the virtual image 117 which is coincident with the depicting screen 112, i.e., the surface of the depicting paper, is drawn on by means of a drawing instrument 125 while the supporting bed 114 and the depicting screen 112 are being driven in synchronism with each other, the pattern of the outer peripheral surface 122 of the column 115 is depicted with the same optical path length from the eyepiece portion 111. Therefore, the scale of the surface pattern all becomes uniform and it is judged that the pattern is a distortion-free pattern.

In the present embodiment, the depicting screen 112 is formed into a planar form and this screen is rectilinearly moved along the rotational direction of the outer peripheral surface 121 of the virtual image 117, but alternatively, the depicting screen 112 may be formed into a cylindrical drum and may be rotated in synchronism with the supporting bed 114. In this case, the diameter of the column 115 and the diameter of the drum may be made equal to each other, whereby the rotary shaft of the drum may be directly connected to the rotary shaft 120 of the supporting bed 114. Of course, the positions of the semi-transparent mirror 113, the supporting bed 114, the depicting screen 112 and the totally reflecting mirror 116 can be suitably changed so that the posture of the operator may be easiest. When the optical path length from the depicting screen 112 to the eyepiece portion 111 becomes too long, a light ray may be used in place of the drawing instrument 125 and an X-Y plotter or the like which follows the movement of the light ray may be used, whereby the pattern of the outer peripheral surface 122 of the column 115 can be automatically depicted by remote control.

Thus, according to the column or cylinder surface pattern depicting method of the present embodiment, the front end of the outer peripheral surface of the virtual image of the column or the cylinder is brought into contact with the surface of the depicting screen and only the portions which are in contact with each other are depicted while the outer peripheral surface of the cylinder and the surface of the depicting screen are being moved at an equal speed. Therefore, it is possible to make a distortion-free developed view or a surface pattern easily and quickly and there is no danger that the outer peripheral surface of the column or cylinder might be damaged.

Figure 4:
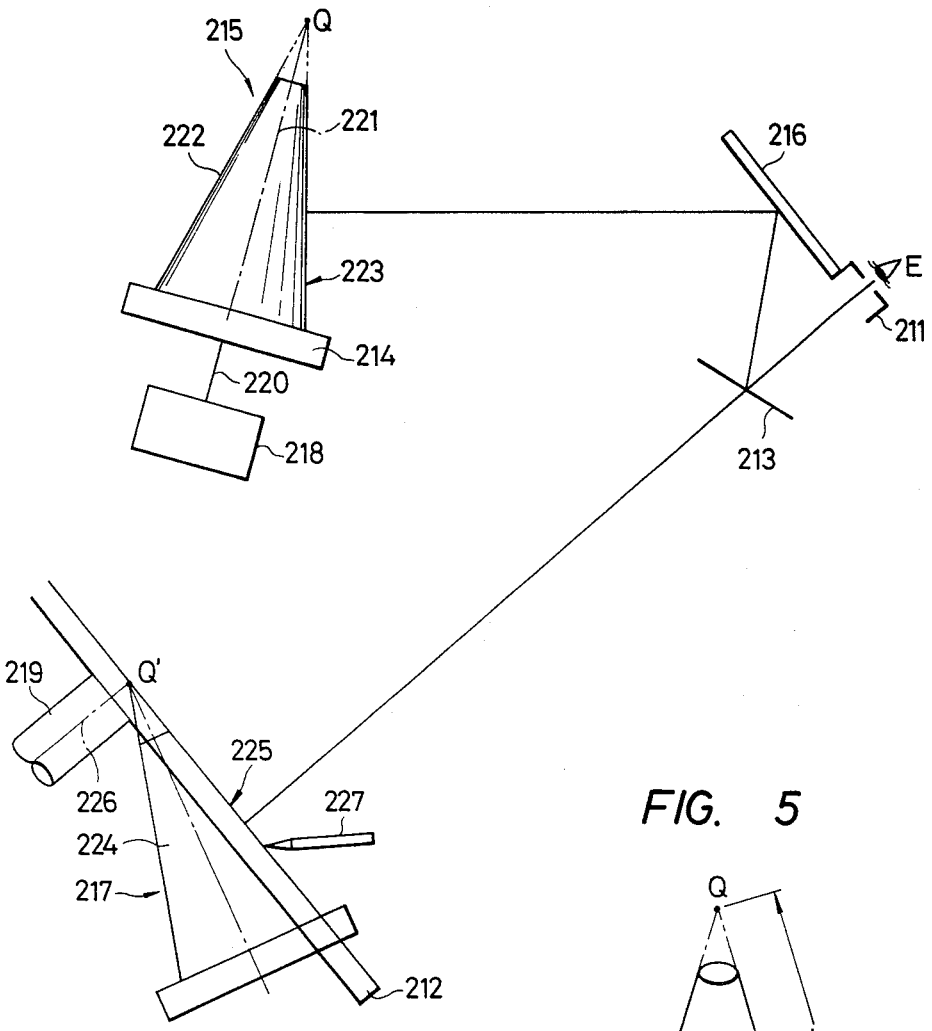
FIG. 4 illustrates the method of the present invention in the case the solid is a cone.
Figure 5:
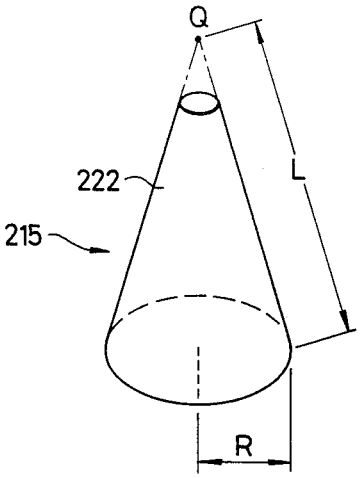
FIG. 5 is a perspective view of a truncated cone.

Now, a version of the method of depicting the surface pattern of a conical body in accordance with the present invention will be described by reference to FIGS. 4,-6. As shown in FIG. 4 which illustrates the principle of the present embodiment, a semi-transparent mirror 213 inclined with respect to the observation direction is disposed between an eyepiece portion 211 for eyes E and a turntable (depicting screen) 212 provided forwardly of the eyepiece portion 211. A totally reflecting mirror 216 for observing a truncated cone 215 placed on a rotatable bed 214 is positioned above the semi-transparent mirror 213. Thus, the optical path from the truncated cone 215 to the eyepiece portion 211 is bent twice, and the virtual image 217 of the truncated cone 215 may be observed as a positive image in the overlapped relationship with the turntable 212. The rotatable bed 214 is rotated by a drive motor 218, and the rotational shaft 219 of the turntable 212 is connected to the rotary shaft 220 of the rotatable bed 214 through reduction gears, not shown, so that these may synchronously operate in a predetermined speed relation. The truncated cone 215 is positioned on the rotatable bed 214 so that the axis 221 of the truncated cone 215 is aligned with the rotary shaft 220 of the rotatable bed 214. The optical path length from the eyepiece portion 211 of the front end 223 of the side 222 of the truncated cone 215 is made equal to the optical path length from the eyepiece portion 211 to the surface of the turntable 212. Therefore, the front end 225 of the side 224 of the virtual image 217 is coincident with the surface of the turntable 212. Also, the rotatable bed 214 is positioned so that the vertex Q' of the cone of the virtual image 217 is coincident with the axis 226 of the shaft 219 of the turntable 212. As shown in FIG. 5, which shows the appearance of the truncated cone 215 in the present embodiment, when the radius of the bottom surface of the truncated cone 215 is R and the length of the generating line to the vertex Q of the cone is L, by setting R/L as the reduction ratio of the reduction gears, it is ensured that the phase of the side 222 of the truncated cone 215 is coincident with the phase of the surface of the turntable 212 when the rotatable bed 214 and the turntable 212 have been synchronously operated.

Figure 6:
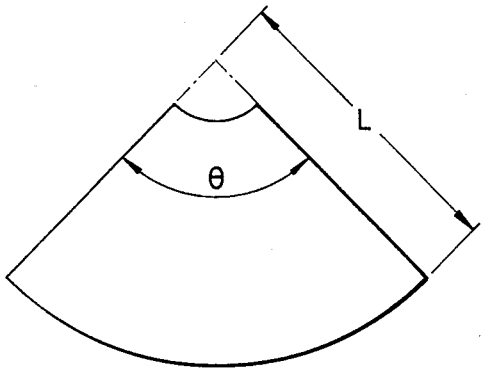
FIG. 6 is a plan view showing the developed shape of the side of the truncated cone of FIG. 5.

Thus, by attaching a sheet of depicting paper, not shown, to the turntable 212, operating the drive motor 218 to synchronously operate the rotatable bed 214 and the turntable 212, and using the drawing instrument 227 to depict only the portion of the front end 225 of the side 224 of the virtual image 217 which is in contact with the surface of the depicting paper, the pattern of the side 222 of the cone 215 can be depicted in the form of a sector, as shown in FIG. 6, which shows the developed form of the developed view by the present embodiment. In this case, it will be convenient if the depicting paper is pre-cut into the shape as shown in FIG. 6 and this is attached to the turntable 212, and in this case, the angle $\theta$ of the sector will be $(R/L\times 360)°$. It is also possible to prepare a member of the same configuration as the truncated cone 215 instead of the turntable 212, wrap the depicting paper of the shape as shown in FIG. 6 around said member so that it becomes coincident with the virtual image 217, and depict while rotating the two at an equal speed. When the optical path length from the turntable 212 to the eyepiece portion 211 is too long for the operator's arm to reach the turntable, a light ray may be used in place of the drawing instrument 227 and an X-Y plotter or the like which follows the movement of the light ray may be used, whereby depiction can be automatically effected by remote control. Of course, the positions of the semi-transparent mirror 213, the eyepiece portion 211, the totally reflecting mirror 216, the turntable 212, etc., may be suitably changed in accordance with the working methods or the like of the operator.

Thus, according to the method of depicting the surface pattern of a conical body in accordance with the present invention, the optical path length from the observation position to the conical body is made equal to the optical path length from the observation position to the depicting screen, so that the front end of the side of the virtual image of the conical body is coincident with the surface of the depicting screen, and the vertex of the cone of the virtual image is positioned on the axis of turn of the depicting screen and further, the peripheral speed of the side of the conical body is made equal to the turn speed of the depicting screen. Therefore, the depiction scale is made uniform on all surfaces by depicting only the portion of the front end of the side of the virtual image which is in contact with the surface of the depicting screen and thus, a distortion-free developed view or a pattern of the side can be depicted easily and quickly. In the present embodiment, the frequency of reflection has been described as "twice", but the present embodiment can also be carried out in an even number of times of reflection.

Figure 7:
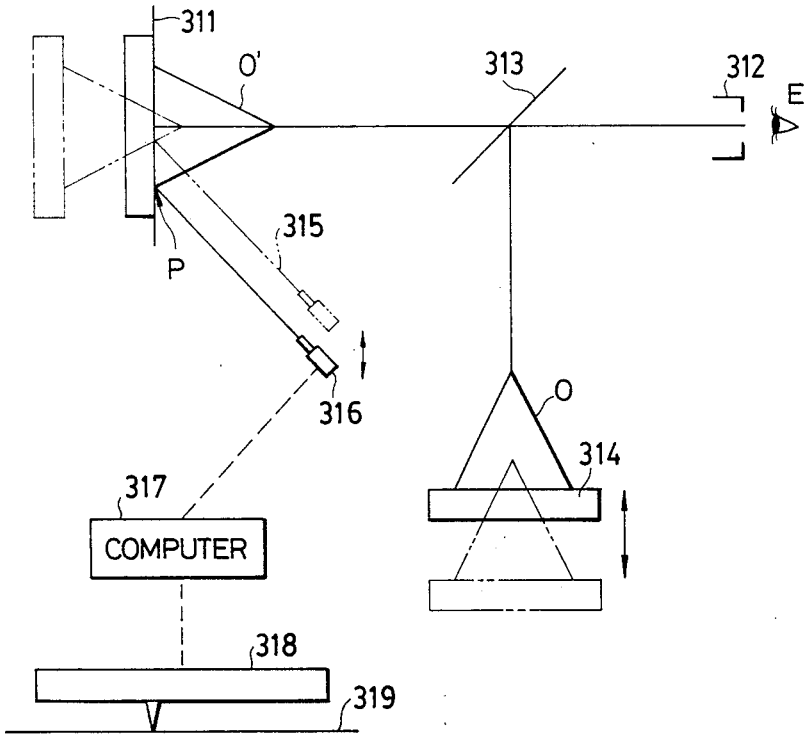
FIG. 7 illustrates the method of the present invention for depicting the contours of a solid.

Next, an embodiment of the method of depicting contour lines in accordance with the present invention will be described in detail by reference to FIG. 7, which illustrates the principle thereof. A semi-transparent mirror 313 inclined obliquely downwardly with respect to the observation direction from an eyepiece portion 312 for two eyes E is disposed between a depicting screen and the eyepiece portion 312, and a solid O placed on a vertically movable supporting bed 314 is positioned below the semi-transparent mirror 313. Accordingly, by the supporting bed 314 being vertically moved so that the optical path length from the semi-transparent mirror 313 to the depicting screen 311 becomes substantially equal to the optical path length from the semi-transparent mirror 313 to the solid O, the virtual image O' of the solid O can be observed on the depicting screen 311. A light ray generator 316, such as a laser oscillator, for applying a light ray 315 toward the depicting screen 311 is movable along the depicting screen 311, and this light ray generator 316 is operated by the operator and moved so that the light ray 315 traces the portion of intersection P between the surface of the depicting screen 311 and the surface of the virtual image O' of the solid O. The movement of this light ray generator 316 is transmitted to a computer 317 and this movement is reproduced by an X-Y plotter 318 controlled by the computer 317, whereby a contour line in the direction of depth, along the observation direction, of the solid O is automatically depicted on depicting paper 319.

Thus, by sequentially moving the supporting bed 314 by a predetermined distance (for example, 1 cm) and tracing the portion of intersection P between the surface of the depicting screen 311 and the surface of the virtual image O', contour lines in the direction of depth, along the observation direction, of the solid O can be succesively depicted at predetermined intervals on the depicting paper 319. In this case, the distance from the portion of intersection P to the eyes E is always constant and therefore, the scale of the contours on the depicting paper 319 becomes uniform, such that the contours thus depicted are orthographically projected ones entirely free of distortion.

In the present embodiment, the horizontally reversed virtual image O' is observed with the image of solid O being reflected once and therefore, where this is corrected by a computer 317 or when the bilaterally symmetric solid O is to be observed, there will occur no problem.

Figure 8:
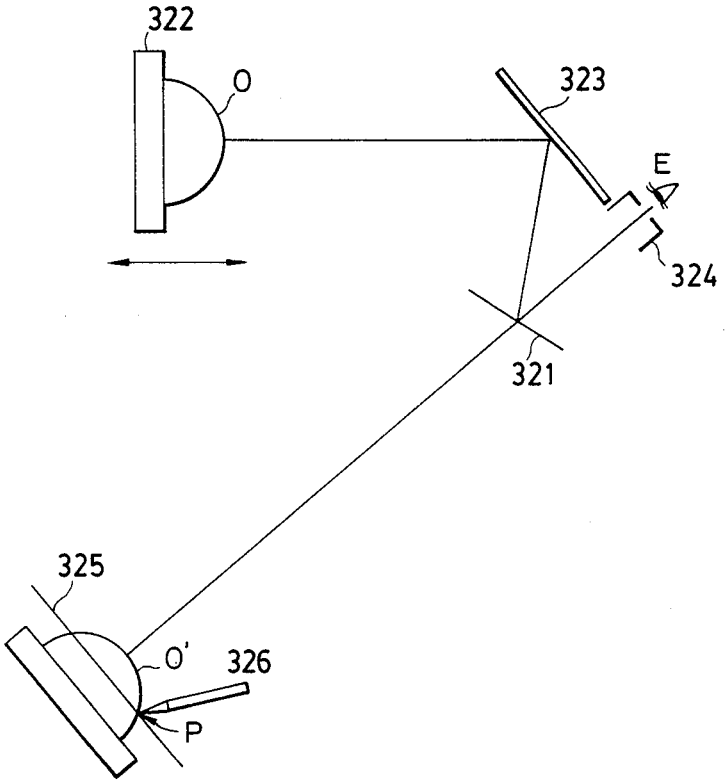
FIG. 8 illustrates a version of the method of the present invention different from that of FIG. 7.

FIG. 8 shows another embodiment of the present invention, in which a totally reflecting mirror 323 is interposed between a semi-transparent mirror 321 and a solid O supported on a supporting bed 322 and from an eyepiece portion 324 for two eyes E, the virtual image O' of the solid O is observed on a depicting screen 325, whereby the virtual image O' becomes an erect image by two reflections and even an asymmetric solid can be depicted easily. When the distance from the eyepiece portion 312 to the depicting screen 311 is so great that the operator's arm cannot reach the depicting screen as in the embodiment shown in FIG. 7, the light ray 315 is necessary to depict contours by remote control, but where the operator's arm can reach the depicting screen 311 as in the present embodiment, the operator may directly use a drawing instrument 326 to trace the portion of intersection P between the depicting paper on the depicting screen 311 and the surface of the virtual image O', thereby depicting contours. Again in the present embodiment, the supporting bed 322 is intermittently moved by a predetermined distance along the depth of the observation direction of the solid O, but when the solid lies at a great distance or is large in size, it will be more convenient to keep the solid O fixed and relatively move the entire apparatus including the semi-transparent mirror 321, the eyepiece portion 324, the depicting screen 325, etc., as a unit. As is apparent from these drawings, the positions of the supporting bed 322, the semi-transparent mirror 321, the depicting screen 325, etc., can of course be changed as desired and may be suitably set correspondingly to the observation direction and the solid O.

Thus, according to the contour depicting method of the present embodiment, the semi-transparent mirror is utilized to ensure observation of the virtual image of the solid on the depicting screen by two eyes and the contour line is depicted by tracing the portion of intersection between the two. Therefore, distortion-free accurate contours can be depicted easily and quickly.

What is claimed is:

1. A method of depicting a contour of a three-dimensional object, comprising the steps of:

forming a virtual image of the three-dimensional object to be depicted by means of a total reflection mirror and a semi-transparent mirror which is inclined with respect to a predetermined direction of observation by two eyes, across a display medium, the object being disposed on one of the reflection and transmission sides of the semi-transparent mirror with respect to the predetermined position of observation by two eyes and the display medium being disposed on the other of the reflection and transmission sides of the semi-transparent mirror with respect to the position of observation; and moving the virtual image of the object relative to the display medium in a direction of depth of the display medium, and tracing a point of intersection between the surface of the virtual image of the object and the display medium.

2. The method of claim 1, wherein said tracing step further comprises:

tracing a point of intersection between the surface of the virtual image of the object and the display medium by means of a light ray;

detecting the tracing position of the light ray by X, Y coordinates; and operating an X-Y plotter in accordance with the obtained X,Y coordinates detection signal.

3. A method of depicting a rotating object, comprising the steps of:

forming a virtual image of at least a portion of the rotating surface of a rotating object to be depicted on a display medium by means of a semi-transparent mirror which is inclined with respect to a predetermined direction of observation by two eyes, said rotating object being disposed on one of the reflection and transmission sides of the mirror with respect to the predetermined position of observation by two eyes and said display medium being disposed on the other of the reflection and transmission sides of the mirror;

moving the display medium in a predetermined synchronous manner with the image of said portion of the rotating surface; and tracing at least one of a contour and a pattern of the image of said portion of the rotating surface on said display medium.

* * * * *

UNITED STATES PATENT AND TRADEMARK OFFICE

CERTIFICATE OF CORRECTION

PATENT NO. : 4,571,835

DATED : February 25, 1986

INVENTOR(S) : MOTOMITSU NISHIO

It is certified that error appears in the above-identified patent and that said Letters Patent is hereby corrected as shown below:

Col. 1, line 49, change "In the" to --In this--.

Col. 3, line 8, change "case the" to --case in which the--.

Col. 3, line 10, " " " " " " "

Col. 3, line 18, change "PREFERRD" to --PREFERRED--.

Col. 3, line 36, change "draftman's" to --draftsman's--.

Col. 4, line 36, change "of other" to --or other--.

Col. 5, line 20, change "easil y" to --easily--.

Col. 6, lines 40-1, change "FIGS. 4,-6./As shown in FIG. 4 which' to --FIGS. 4-6./As shown in FIG. 4, which--.

Col. 7, line 63, change "in" to --with--.

Signed and Sealed this

Fourth Day of November, 1986

[SEAL]

*Attest:*

*Attesting Officer*

DONALD J. QUIGG

*Commissioner of Patents and Trademarks*